US009392386B2

(12) United States Patent
Sheth et al.

(10) Patent No.: US 9,392,386 B2
(45) Date of Patent: Jul. 12, 2016

(54) AUDIO SIGNAL ADJUSTMENT FOR MOBILE PHONE BASED PUBLIC ADDRESSING SYSTEM

(71) Applicant: QUALCOMM Incorporated, San Diego, CA (US)

(72) Inventors: Soham Vikrambhai Sheth, San Diego, CA (US); Samir Salib Soliman, Poway, CA (US); Arungundram Chandrasekaran Mahendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 171 days.

(21) Appl. No.: 14/213,445

(22) Filed: Mar. 14, 2014

(65) Prior Publication Data

US 2015/0264497 A1 Sep. 17, 2015

(51) Int. Cl.
*H04R 27/00* (2006.01)
*H04R 3/02* (2006.01)

(52) U.S. Cl.
CPC ..... *H04R 27/00* (2013.01); *H04R 3/02* (2013.01); *H04R 2420/07* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 5,768,263 | A * | 6/1998 | Tischler | H04M 3/569 370/263 |
| 5,999,631 | A | 12/1999 | Porayath et al. | |
| 7,412,533 | B1 * | 8/2008 | Johnson | H04L 12/1827 348/E7.083 |
| 8,103,019 | B1 | 1/2012 | Pandey et al. | |
| 8,204,742 | B2 | 6/2012 | Yang et al. | |
| 8,442,251 | B2 | 5/2013 | Jensen et al. | |
| 2009/0168984 | A1 * | 7/2009 | Kreiner | H04M 3/2227 379/202.01 |
| 2012/0269362 | A1 | 10/2012 | Sheth et al. | |
| 2013/0156223 | A1 | 6/2013 | Huang | |

FOREIGN PATENT DOCUMENTS

EP 2224753 A1 9/2010

OTHER PUBLICATIONS

International Search Report and Written Opinion—PCT/US2015/019533—ISA/EPO—Jun. 18, 2015.
Behringer, "Feedback Destroyer Pro DSP1124P—User's Manual" Version 1.0, Feb. 2001, 25 pp.

* cited by examiner

*Primary Examiner* — Muhammad N Edun
(74) *Attorney, Agent, or Firm* — Foley & Lardner LLP

(57) ABSTRACT

Systems are described for managing audio in a public addressing (PA) system, the system comprising a host configured to generate an adjustment request; and a client configured to establish a session with a personal communication device (PCD); receive a first audio sample from the PCD; transmit the first audio sample to the PA system; receive the adjustment request from the host; receive a second audio sample from the PCD; and adjust the second audio sample in response to the adjustment request.

21 Claims, 12 Drawing Sheets

AUDIO SIGNAL ADJUSTMENT FOR MOBILE PHONE BASED PUBLIC ADDRESSING SYSTEM

BACKGROUND

1. Field

The disclosure relates generally to a public addressing (PA) system. In particular, this disclosure relates to using personal communication devices (PCDs) as microphones for a PA system.

2. Background

The addition of processing power, media processing capabilities, and high-bandwidth radio technologies to PCDs offers possibilities to develop novel solutions that may better user experience and improve productivity for various fields. In particular, the PCDs may be used to improve a PA system.

For example, hosts and attendees of a conference or seminar require access to the PA system for giving lecture, providing input, asking questions, and making comments. Typically, a microphone is passed or delivered to a user to allow the user access to the PA system. The passing and delivering of the microphone create inconvenience to the hosts/attendees, and a considerable amount of time is consumed in the process. To avoid the passing and the delivering of the microphones, PCDs (e.g., mobile phones) may be implemented to interface with the PA system such that the PCDs may act as microphones. Given that almost everyone has a PCD, the user may simply use his or her own PCD as a microphone when the user desires to access the PA system.

However, a drawback for using the PCDs as microphones is that feedback may occur. Feedback (also known as howling) occurs when a sound that has been captured, amplified, and broadcasted by the PA system is recaptured by the microphone of the PCD and amplified/broadcasted again. In this manner, a loop is created such that the sound is continuously being re-amplified over a short period of time. Such loops produce, with the speakers of the PA system, a high-pitched (howling) sound that is extremely unpleasant to the ears. Conventional PA systems are not capable of supporting sophisticated howling suppression techniques. Therefore, PCDs with sensitive microphones usually create feedback when used as microphones to the PA systems.

Moreover, feedback is especially likely to occur if audio signals (from multiple PCDs) having different amplitude ranges are fed into the input of the PA system. Although the conventional PA systems may be capable of suppressing feedback for a first amplitude range, such systems may not be capable of suppressing feedback for a second amplitude range which is greater than the first amplitude range. Thus, the conventional PA systems may not support feedback suppression for PCDs that output audio signals to the PA systems at different amplitude ranges.

One factor contributing to audio signals having different amplitude ranges is that PCDs may include hardware (e.g., microphones) with different performance characteristics. This is because the PCDs may be made by different manufacturers. Even different models from the same manufacturer may contain hardware from different component suppliers, such that the hardware may have different performance characteristics.

Another factor is that the speaking habits of the users may be different. For example, some may speak loudly (or keep the PCD close) while others may speak softly (or keep PCD far). Yet another factor is that different speakers of the PA system may have different performance characteristics related to outputting sound. Some other factors include, but are not limited to, the user's distance from the speakers, the microphone's frequency response, the sensitivity of the microphone, the direction of the microphone relative to the user, the acoustics of the room, the direction of the speaker with respect to user's location, and/or the like.

SUMMARY

A system for adjusting audio signals in a public addressing (PA) system includes, but is not limited to any one or combination of a host configured to generate an adjustment request; and a client configured to establish a session with a personal communication device (PCD); receive a first audio sample from the PCD; transmit the first audio sample to the PA system; receive the adjustment request from the host; receive a second audio sample from the PCD; and adjust of the second audio sample in response to the adjustment request.

In various embodiments, the host is configured to generate the adjustment request in response to detecting a triggering event.

In some embodiments, the triggering event is a user input received at the host.

In various embodiments, adjusting the second audio sample comprises at least one of the following: scaling amplitude of the second audio sample; changing at least one directionality of a microphone; and filtering out at least one frequency range of the second audio sample.

In various embodiments, adjusting the second audio sample comprises providing the PCD with the adjustment request.

A method of adjusting audio signals in a public addressing (PA) system includes, but is not limited to any one or combination of establishing a session with a source device; receiving a first audio sample from the source device; transmitting the first audio sample to the PA system; receiving an adjustment request from a host; receiving a second audio sample from the source device; and adjusting the second audio sample in response to the adjustment request.

In various embodiments, the source device comprises a personal communication device (PCD).

In various embodiment, adjusting the second audio sample comprises at least one of the following: scaling amplitude of the second audio sample; changing at least one directionality of a microphone; and filtering out at least one frequency range of the second audio sample.

A method of managing audio signals in a public addressing (PA) system implementing a personal communication device (PCD) includes, but is not limited to any one or combination of establishing a session with a client; receiving a first audio sample from a user of the PCD; transmitting the audio sample to the client; receiving an adjustment request; receiving, based on the adjustment request, a second audio sample from the user; and transmitting the second audio sample to the client.

In various embodiments, the receiving, based on the adjustment request, comprises: configuring at least one microphone of the PCD based on the adjustment request; and receiving the second audio sample via the configured microphone.

In various embodiments, the receiving, based on the adjustment request, comprises receiving the second audio sample and adjusting the second audio sample.

In some embodiments, the receiving, based on the adjustment request, further comprises: receiving the second audio sample; and adjusting the second audio sample based on the adjustment request.

In various embodiments, the receiving, based on the adjustment request, a second audio sample from the user, comprises scaling amplitude of the second audio sample changing at least one directionality of a microphone; and filtering out at least one frequency range of the second audio sample.

In various embodiments, the adjustment request is received from the client or a host associated with the client.

In various embodiments, the adjustment request is received in response to a feedback signal.

In some embodiments, the feedback signal is detected by the PCD automatically.

In some embodiments, the PCD is configured to determine whether the first audio sample exceeds a predetermined threshold, and the feedback signal is detected when the first audio sample exceeds the predetermined threshold.

In some embodiments, the feedback signal is detected by the client automatically.

In some embodiments, the client is configured to determine whether the first audio sample exceeds a predetermined threshold, and the feedback signal is detected when the first audio sample exceeds the predetermined threshold.

DETAILED DESCRIPTION

In general, various embodiments relate to audio signal adjustment for a public addressing (PA) system having personal communication devices (PCDs) as microphones. In particular, the various embodiments are directed toward manually and/or automatically adjusting audio signal for the PA system to suppress or otherwise manage feedback in the PA system.

Figure 1:
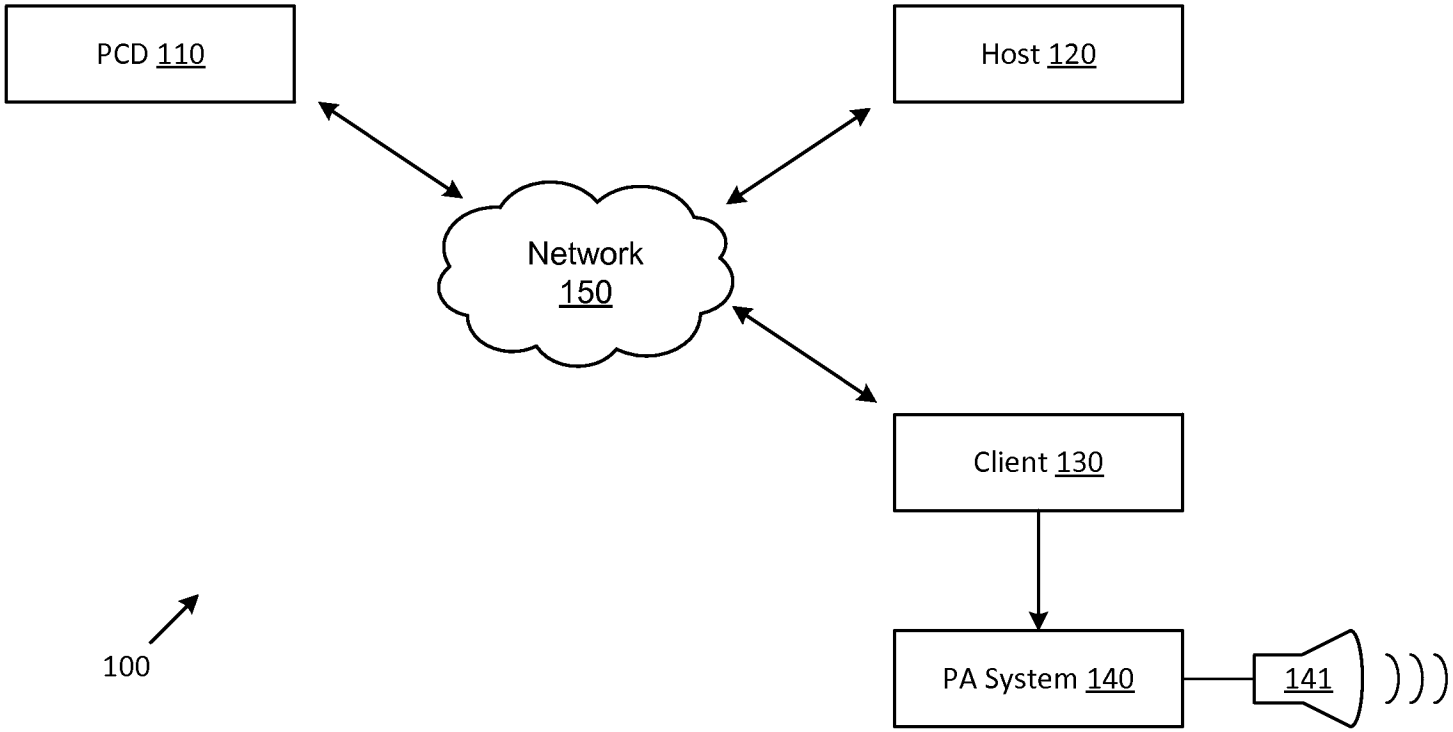
FIG. 1 is a diagram illustrating an audio signal adjustment system according to various embodiments.

Referring to FIG. 1, a system 100 is illustrated in accordance with various embodiments. The system 100 may include of a PCD 110, a host 120, a client 130, and a PA system 140. The PA system 140 may include at least one speaker 141 configured to broadcast sound. Examples of the PA system 140 include, but are not limited to, a home-theater system, an ad-hoc PA system, a karaoke system, any set-up including at least one speaker, and/or the like. In some embodiments, the PCD 110, the host 120, and the client 130 may be connected to one another through a network 150. The network 150 may provide for data transmission between two or more of the components (e.g., the PCD 110, the host 120, the client 130, and the PA system 140) of system 100. The network 150 may be any wired or wireless network. The client 130 and the PA system 140 may be connected to each other in any suitable manner. For instance, the client 130 and the PA system 140 may be connected to each other through any wired or wireless network. In particular embodiments, the PCD 110, the host 120, the client 130, and the PA system 140 may all be connected to each other through the same network 150. In some embodiments, one of the components 110, 120, 130, 140 may be operatively coupled to at least one of the other components.

In some embodiments, each of the components 110, 120, 130, 140 may be provided in a separate device (e.g., provided in a separate device or housed in a separate device housing). Providing each of the components 110, 120, 130, 140 in a separate device may provide finer granularity. As the total amount of processing of the system 100 is shared by multiple components 110, 120, 130, 140, the overall efficiency of audio signal adjustment may be improved given that the finer granularity can lead to shorter execution time.

In other embodiments, two or more of the components 110, 120, 130, 140 may be provided in a same device. In one example, the host 120 and the client 130 may be provided in a same device (e.g., a tablet). In yet another example, the client 130 and the PA system 140 may be provided in a same device (e.g., the PA system 140). In yet another example, the PCD 110 and the host 120 may be provided in a same device (e.g., the PCD 110). In yet another example, the PCD 110 and the client 130 may be provided in a same device (e.g., the PCD 110). In yet another example, the PCD 110, the host 120, and the client 130 may be provided in a same device (e.g., the PCD 110). The examples mentioned here are for illustrative purposes only and are not meant to provide an exhaustive list. The advantage associated with providing two or more of the components 110, 120, 130, 140 in the same device is that such components may utilize greater processing power and memory capacity of the device. For example, given the high processing capabilities of the PCDs (e.g., smartphones) today, it is advantageous to rely on the processing power of the PCDs for improved performance by allowing two or more of the components 110, 120, 130, 140 to use hardware and software of the PCD 110.

Figure 2:
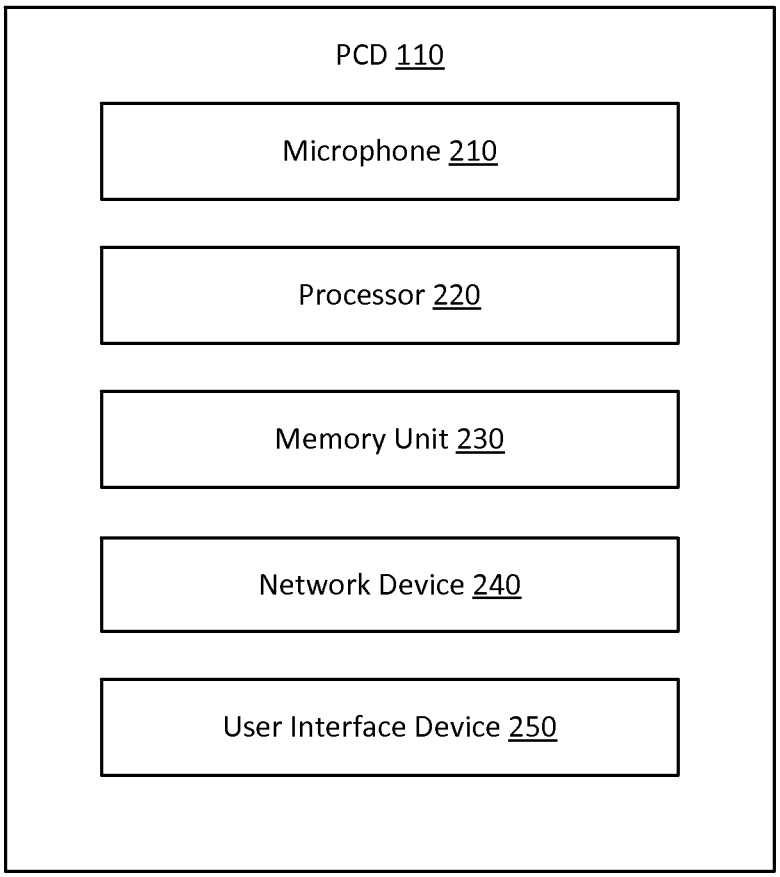
FIG. 2 is a block diagram illustrating an example of a PCD for implementation within the audio signal adjustment system according to various embodiments.

Referring to FIGS. 1-2, an example of the PCD 110 is illustrated in accordance with various embodiments. In various embodiments, the PCD 110 (also known as a source device) may be an electronic mobile device configured to capture sound, process the sound, output audio signal representing the sound to other components, and/or the like. In addition, the PCD 110 may be configured to adjust the audio signal. Examples of the PCD 110 may include, but are not limited to, smartphones (mobile phones), pagers, tablets, PDAs, any mobile computing systems, and/or the like. The PCD 110 may include at least one microphone 210, at least one processor 220, at least one memory unit 230, a network device 240, and an user interface device 250.

In some embodiments, the at least one microphone 210 may be configured to capture sound from a user of the PCD 110 as the user speaks. In some embodiments, the at least one microphone 210 may be integrated with the PCD 110 or otherwise housed inside of a housing of the PCD 110. In other embodiments, the at least one microphone 210 may be an auxiliary microphone not integrated with the PCD 110, but is operatively coupled to the PCD 110 in any suitable manner. In some embodiments, the at least one microphone 210 may be an omnidirectional microphone that may be configured to capture sound from any direction. In some embodiments, the at least one microphone 210 may be a unidirectional microphone that may be configured to capture sound from one direction. In some embodiments, the at least one microphone 210 may be a microphone of any other polarization pattern. In the case that the at least one microphone 210 may be configured to capture sound from a plurality of directions, the PCD 110 may be configured to deactivate capturing sound from at least one direction of the plurality of directions.

In some embodiments, the at least one microphone 210 may be a plurality of microphones having the same polarization pattern (e.g., all of the plurality of microphones may be unidirectional microphones, or all of the plurality of microphones may be omnidirectional microphones). In some embodiments, at least two microphones of a plurality of microphones 210 may have different polarization patterns (i.e., if the plurality of microphones include three microphones, two of the three microphones may be omnidirectional microphones and the other microphone may be a unidirectional microphone).

In some embodiments, the at least one processor 220 may be operatively coupled to the at least one memory unit 230 for processing the audio signal. For example, the at least one processor 220 and the at least one memory unit 230 may be configured to perform functions of the PCD 110 as described in the disclosure. In some embodiments, the at least one processor 220 and the at least one memory unit 230 may be used for processes of the PCD 110 that are unrelated to processing audio signal for the PA system 140.

In some embodiments, the network device 240 may be configured for accessing the network 150 such that data may be transmitted via the network 150 to and from the PCD 110. In some embodiments, the network device 240 may be a wireless device of the PCD 110, such as a wireless local area network (WLAN) device, wireless wide area network (WWAN) device, personal area network (PAN) device, and/or the like. In other embodiments, the network device 240 may allow for a wired connection to the network 150 or other components of the system 100.

In some embodiments, the user interface device 250 may be configured to provide information to the user and/or to accept user input. The user may control the PCD 110 with the user interface device 250. The user interface device 250 may include at least one display for graphical user interface (GUI). The user interface device 250 may also include at least one user input device, such as a touch screen, a keyboard, a mouse, and/or the like.

Figure 3:
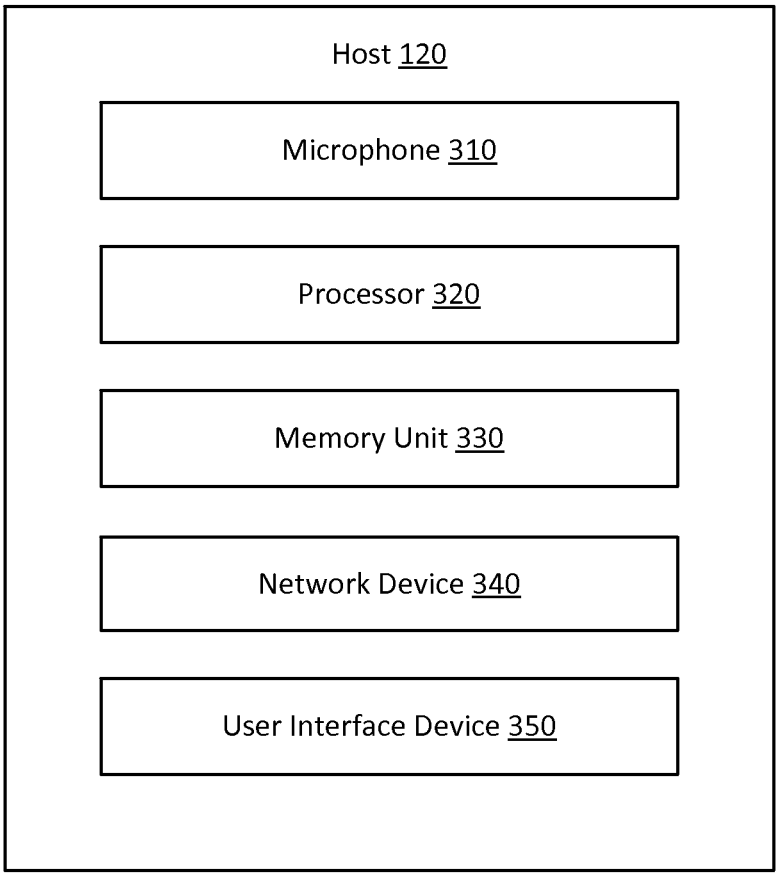
FIG. 3 is a block diagram illustrating an example of a host for implementation within the audio signal adjustment system according to various embodiments.
Figure 4:
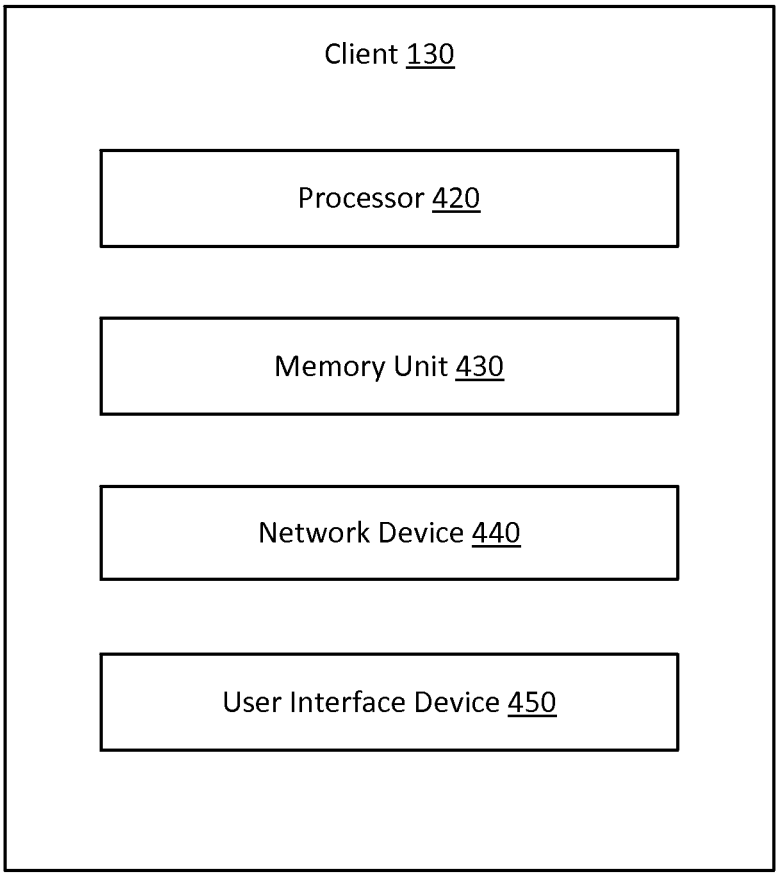
FIG. 4 is a block diagram illustrating an example of a client for implementation within the audio signal adjustment system according to various embodiments.
Figure 5:
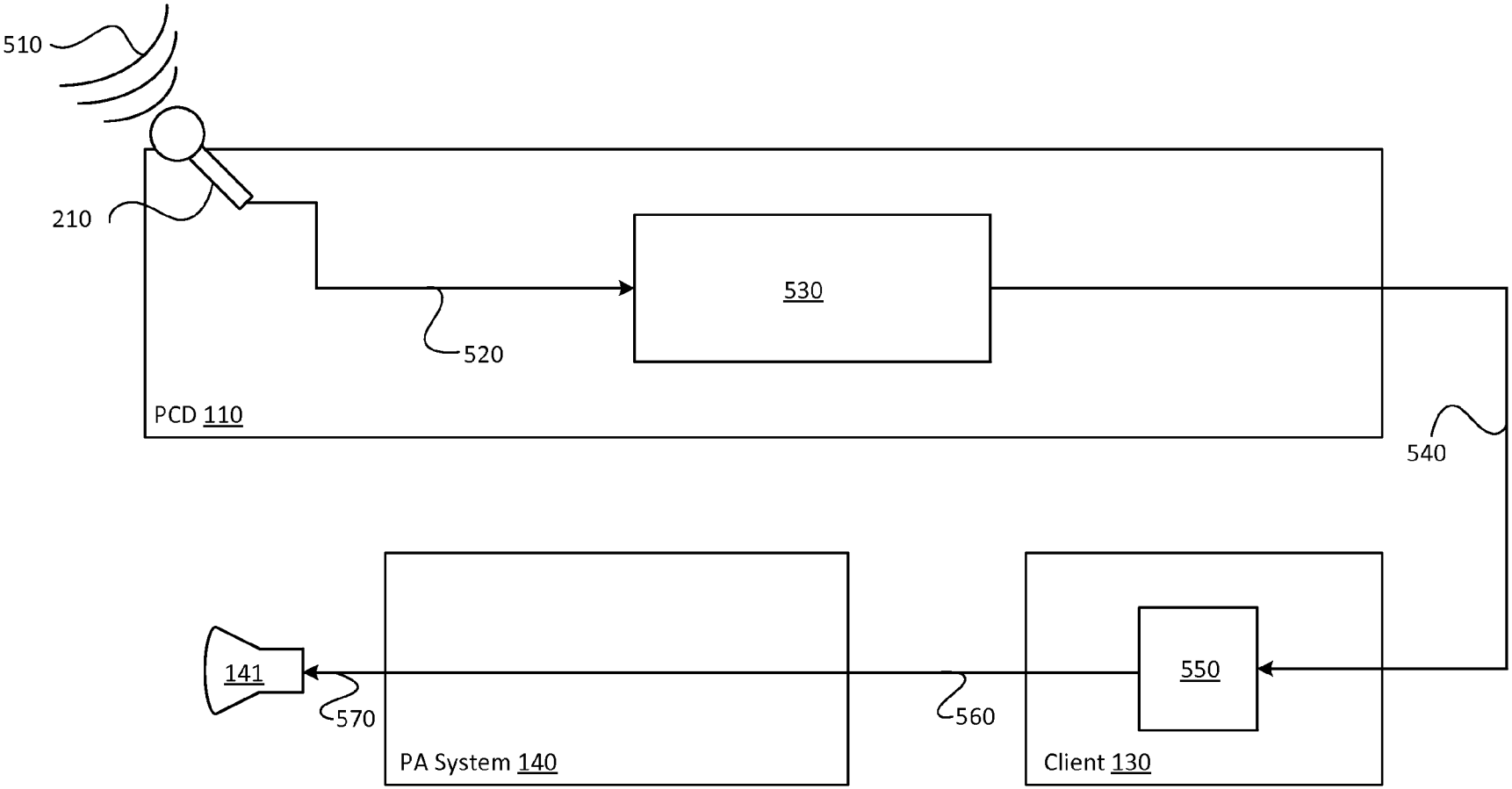
FIG. 5 is a diagram illustrating examples of audio signals that may be adjusted according to various embodiments.
Figure 6:
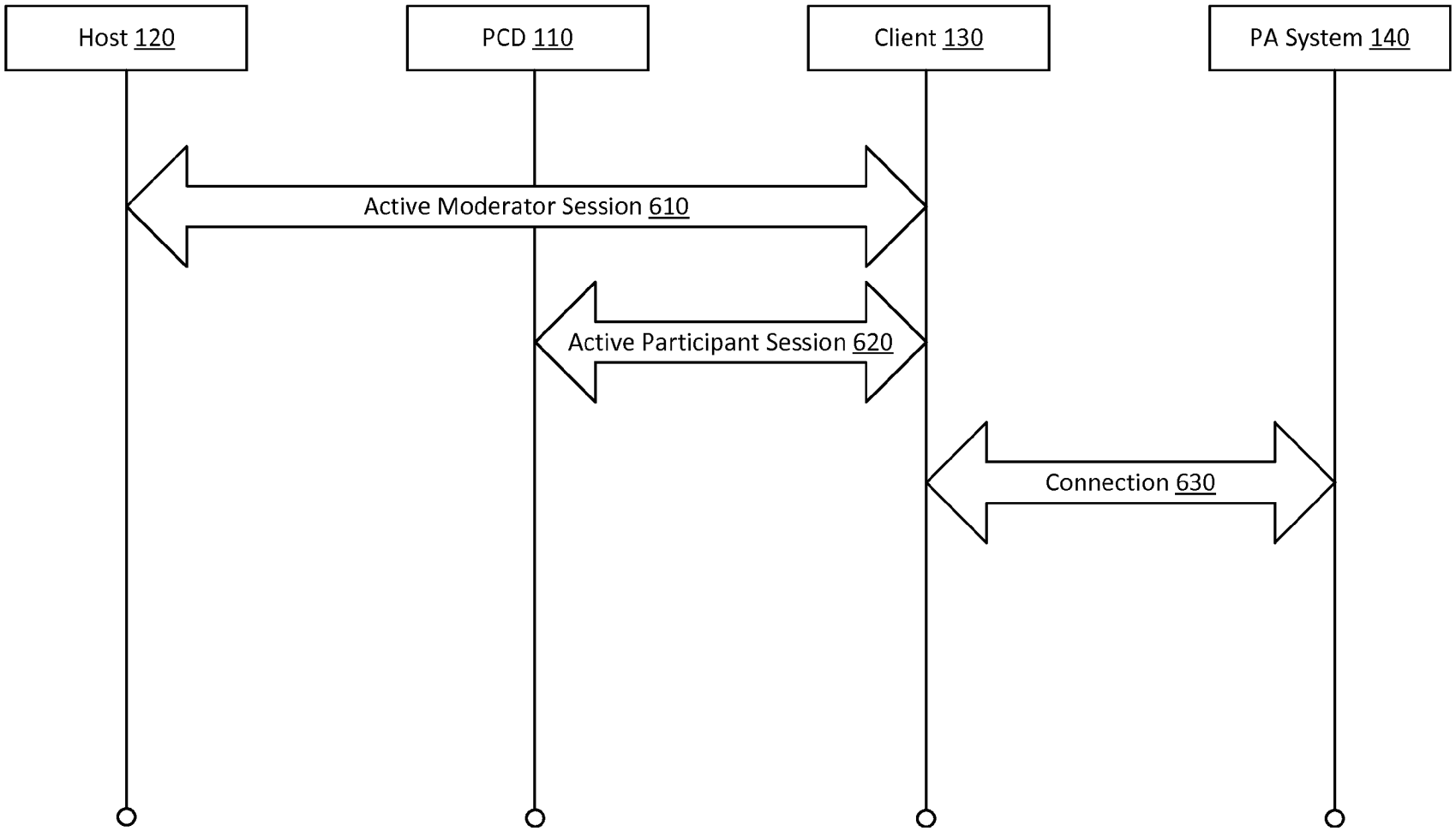
FIG. 6 is a diagram illustrating examples of interaction between components of the audio signal adjustment system according to various embodiments.
Figure 7:
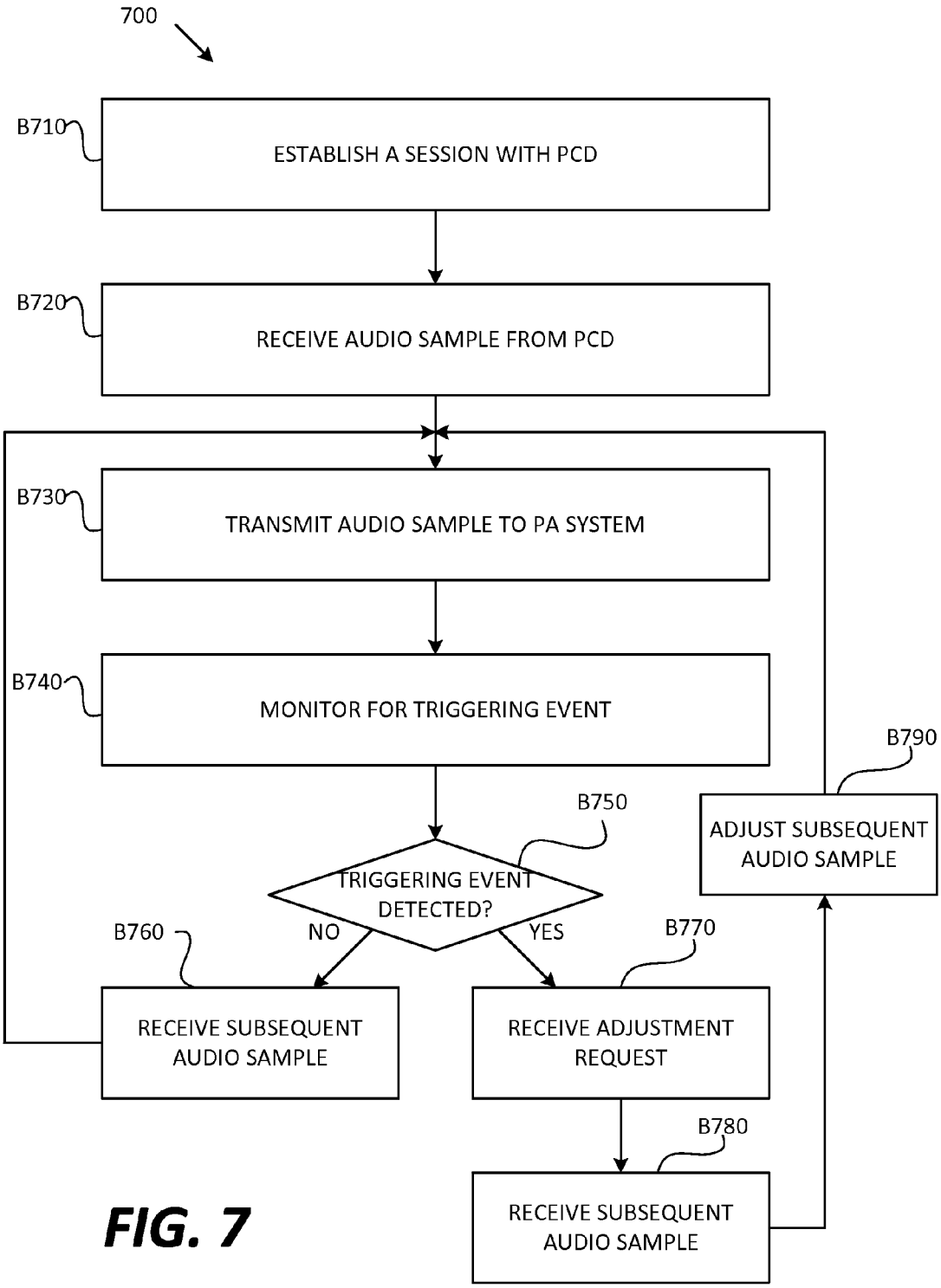
FIG. 7 illustrates a process flowchart of a method for manually adjusting the audio signals according to various embodiments.
Figure 8:
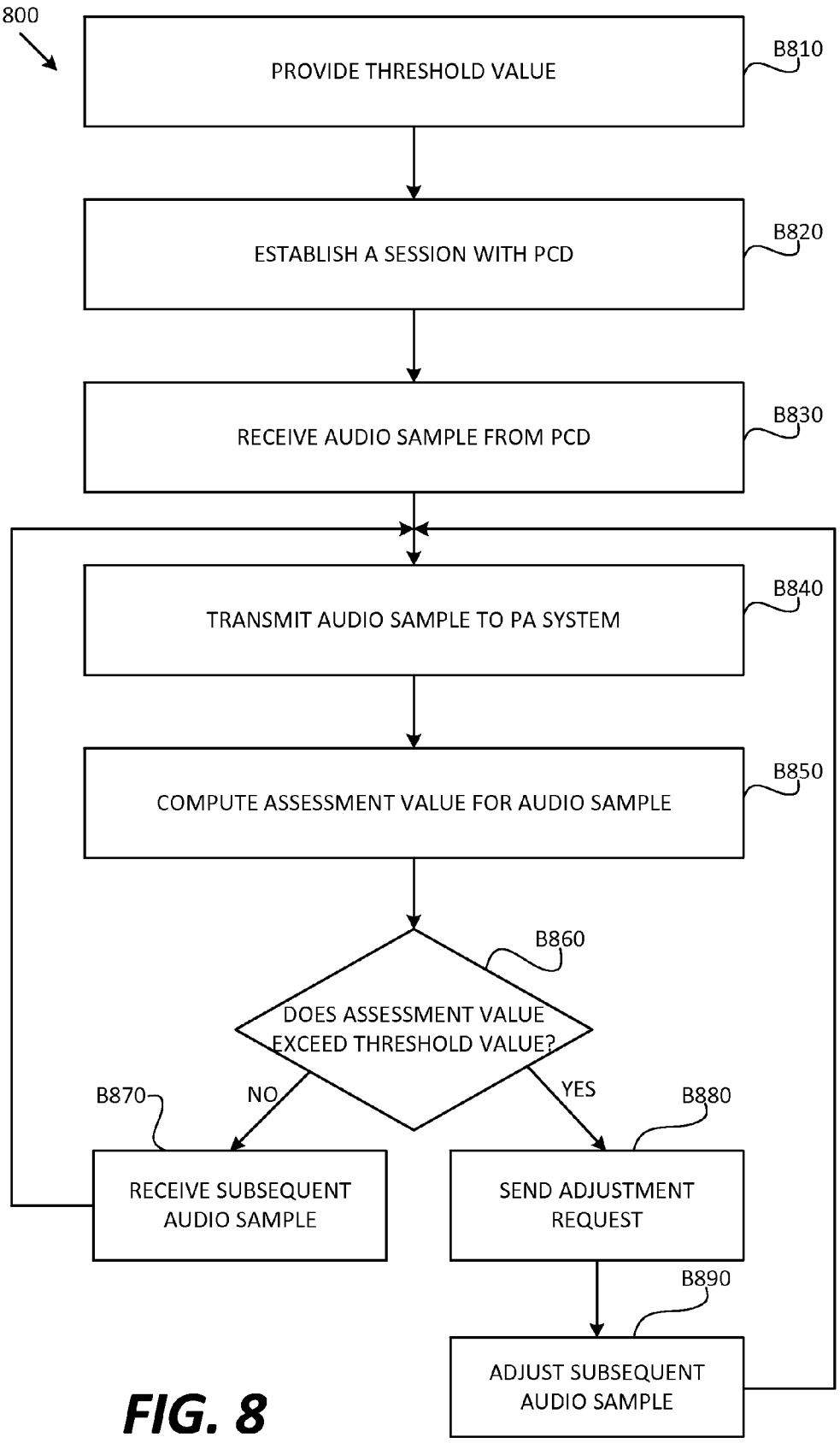
FIG. 8 illustrates a process flowchart of a method for automatically adjusting the audio signals according to various embodiments.

Referring to FIGS. 1-3, an example of the host 120 is illustrated in accordance with various embodiments. In various embodiments, the host 120 (also known as a moderator device) may be an electronic device that allows control and regulation of various aspects of the system 100. For example, the host 120 may provide access to the PA system 140 to prospective users (and their PCDs 110), control duration of the access, terminate the access, enable multiple users to access the PA system 140 concurrently, and/or the like. Examples of the host 120 includes but are not limited to, a desktop computer, a laptop computer, a PCD, a system on chip, a tablet, a pager, a dongle, and/or the like. The host 120 may include at least one microphone 310, at least one processor 320, at least one memory unit 330, a network device 340, and an user interface device 350.

The host 120 may be configured to suppress feedback by generating indication to suppress feedback and/or to increase volume of the outputted sound. In some embodiments, the host 120 may dynamically and remotely control various parameters of the PCD 110, the client 130, and/or the PA system 140. In some embodiments, the host 120 may be manually operated by an operator (e.g., a moderator) to control various aspects of the system 100. In some embodiments, the host 120 may be configured to control various aspects of the system 100 automatically without any manual input.

In some embodiments, the at least one processor 320 may be operatively coupled to the at least one memory unit 330 for adjusting audio signal. For example, the at least one processor 320 and the at least one memory unit 330 may be configured to perform functions of the host 120 as described in the disclosure. In some embodiments, the at least one processor 320 and the at least one memory unit 330 may be used for processes of the host 120 that are unrelated to processing audio signal for the PA system 140.

In some embodiments, the network device 340 may be configured for accessing the network 150 so that data may be transmitted via the network 150 to and from the host 120. In some embodiments, the network device 340 may be a wireless device of the host 120, such as a wireless local area network (WLAN) device, wireless wide area network (WWAN) device, personal area network (PAN) device, and/or the like. In other embodiments, the network device 340 may allow for a wired connection to the network 150 or other components of the system 100.

In some embodiments, the user interface device 350 may be configured to provide information to the operator and/or to accept operator input. The user interface device 350 may include at least one display for graphical user interface (GUI). The user interface device 350 may also include at least one user input device, such as a touch screen, a keyboard, a mouse and/or the like. The user interface 350 may support interaction with the operator, i.e., the operator may indicate, through the user interface, whether a triggering event (e.g., feedback or insufficient output volume) has occurred.

In some embodiments, the host 120 may be configured to automatically detect, with the at least one microphone 310, whether a triggering event has occurred. In some embodiments, the at least one microphone 310 may be integrated with the host 120 or otherwise housed inside of a housing of the host 120. In some embodiments, the at least one microphone 310 may be an auxiliary microphone not integrated with the host 120, such that the at least one microphone 310 may be operatively coupled to the host 120 in any suitable manner. In some embodiments, the at least one microphone 310 may be an omnidirectional microphone that may capture sound from any direction. In some embodiments, the at least one microphone 310 may be a unidirectional microphone that may capture sound in only one direction. In some embodiments, the at least one microphone 310 may be a microphone of any other polarization pattern. In some embodiments, at least two of the plurality of microphones have different polarization patterns (e.g., the plurality of microphones include three microphones, two of the three microphones may be omnidirectional microphones, and the other microphone may be a unidirectional microphone). In other embodiments, the at least one microphone 210 may be a plurality of microphones having the same polarization pattern (e.g., all of the plurality of microphones may be unidirectional microphones, or all of the plurality of microphones may be omnidirectional microphones).

Referring to FIGS. 1-4, an example of the client 130 is illustrated in accordance with various embodiments. In various embodiments, the client 130 (also known as a sink device) may be an electronic device that serves as an intermediary between the PCD 110, the host 120, and the PA system 140. For example, the client 130 may be connected to the PCD 110 (which may transmit audio signal to the client 130 via the network 150), the host 120 (which may transmit adjustment requests to the client 130), the PA system 140 (which may broadcast the audio signal provided by the client 130). Examples of the client 130 include, but are not limited to, a desktop computer, a laptop, a PCD, a system on chip, a tablet, a pager, a dongle, and/or the like. In some embodiments, the client 130 may include of at least one processor 420, at least one memory unit 430, a network device 440, and an user interface device 450. In further embodiments, the client 130 may further include at least one microphone (not shown).

In some embodiments, the at least one processor 420 may be operatively coupled to at least one memory unit 430 for processing audio signal and adjustment request processing. For example, the at least one processor 420 and the at least one memory unit 430 may be configured to perform functions of the client 130 as described in the disclosure. In some embodiments, the at least one processor 420 and the at least one memory unit 430 may be used for processes of the client 130 that are unrelated to processing audio signal for the PA system 140.

In some embodiments, the network device 440 may be configured for accessing the network 150 so data may be transmitted via the network 150 to and from the client 130. In some embodiments, the network device 440 may be a wireless device of the client 130, such as a wireless local area network (WLAN) device, wireless wide area network (WWAN) device, personal area network (PAN) device, and/or the like. In other embodiments, the network device 440 may allow for a wired connection to the network 150 or other components of the system 100.

In some embodiments, the user interface device 450 may be configured to provide information to the user and/or to accept user input. The user interface device 450 may include at least one display for graphical user interface (GUI). The user interface device 450 may also include at least one user input device, such as a touch screen, a keyboard, a mouse, and/or the like. The user interface 450 may support interaction with the user and/or the operator, i.e., the user or the operator may indicate, through the user interface, whether a triggering event (e.g., feedback or insufficient output volume) has occurred.

Referring to FIGS. 1-5, examples of audio signals that may be adjusted are illustrated in accordance with various embodiments. In various embodiments, one or more of the PCD 110, the client 130, and the PA system 140 may be configured to adjust the audio signals to manage feedback by the system 100. For instance, in some embodiments, the amplitude of the audio signals may be scaled by one or more of the components (e.g., the PCD 110, the client 130, and the PA system 140). In some embodiments, frequency ranges or sound-capturing directions of the microphone 210 may be adjusted to suppress feedback.

In some embodiments, sound 510 may be captured by the at least one microphone 210 of the PCD 110 from at least one sound-capturing direction. The at least one microphone 210 may be configured to capture sound from all available directions depending on the polarization of the microphone 210. In some embodiments, the at least one microphone 210 may be configured to deactivate in (or otherwise ignore) at least one sound-capturing direction (or otherwise to change the polarization of the microphone 210). In some embodiments, the at least one microphone 210 may be a plurality of microphones. The PCD 110 also may deactivate at least one of the plurality of microphones that are capturing sound 510. By deactivating sound-capturing from any directions that generate feedback, the at least one microphone 210 may capture as much sound 510 from the user as possible while still suppressing feedback.

In some embodiments, the microphone 210 may output a microphone signal 520 (e.g., corresponding to the captured sound 520). In some embodiments, the microphone signal 520 may be provided to at least one processing unit 530 of the PCD 110 to adjust the microphone signal 520, for example, to manage feedback, adjust volume, and/or the like. The processing unit 530 may include the at least one processor 220 and the at least one memory unit 230. In some embodiments, if insufficient output volume is detected (e.g., by the host 120 or the operator thereof), the amplitude of the microphone signal 520 may be increased in response, thus increasing the output volume. In some embodiments, if feedback is detected, the amplitude of the microphone signal 520 may be decreased in response, thus decreasing the volume of the outputted sound and managing feedback. In some embodiments, the processing unit 530 may be configured to filter out at least one frequency range in which feedback is occurring. In some embodiments, the processing unit 530 may perform the function of at least one high-pass filter, at least one band-pass filter, at least one low-pass filter, at least one band-stop filter, and/or the like.

In some embodiments, the PCD 110 may output PCD output signal 540 (e.g., corresponding to the microphone signal 520). In some embodiments, if insufficient output volume is detected, the amplitude of the PCD output signal 540 may be increased in response, thus increasing the volume of the outputted sound. In some embodiments, if feedback is detected, the amplitude of the PCD output gain 540 may be decreased in response, thus decreasing the volume of the outputted sound and reducing feedback. In some embodiments, the processing unit 530 may be configured to adjust the PCD output signal 540.

In some embodiments, the client 130 may output a client output signal 560 (e.g., corresponding to the PCD output signal 540). In some embodiments, the PCD output signal 540 may be provided to at least one client processing unit 550 of the client 130 to adjust the PCD output signal 540, for example, to manage feedback, adjust volume, and/or the like. The client processing unit 550 may include the at least one processor 420 and the at least one memory unit 430. In some embodiments, if insufficient output volume is detected, the client processing unit 550 may increase the amplitude of the PCD output signal 540 in response, thus increasing the volume of the outputted sound. In some embodiments, if feedback is detected, the client processing unit 550 may decrease the amplitude of the PCD output signal 540 in response, thus decreasing the volume of the outputted sound and reducing feedback. In some embodiments, the client processing unit 550 may be configured to filter out at least one frequency range of the PCD output signal 540 in which feedback is occurring. In some embodiments, the processing unit 550 may perform the function of at least one high-pass filter, at least one band-pass filter, at least one low-pass filter, at least one band-stop filter, and/or of the like.

In some embodiments, the PA system 140 may output a speaker signal 570 (e.g., corresponding to the client output signal 560). In some embodiments, the client output signal 560 may be provided to at least one processing unit (not shown) of the PA system 140 to adjust the client output signal 560, for example, to manage feedback, adjust volume, and/or the like. The processing unit may include at least one processor (not shown) coupled to at least one memory unit (not shown). A speaker signal 570 may be provided by the PA system 140 to the at least one speaker 141. In some embodiments, if insufficient output volume is detected, the amplitude of the client output signal 560 may be increased in response, thus increasing the volume of the outputted sound. In some embodiments, if feedback is detected, the amplitude of the client output signal 560 may be decreased in response, thus decreasing the volume of the outputted sound and reducing feedback.

In some embodiments, one of the audio signals 520, 540, 560, 570 may be adjusted. In other embodiments, two or more of the audio signals 520, 540, 560, 570 may be adjusted. For example, a frequency adjustment may be performed on the PCD output signal 540 by the processing unit 530 of the PCD 110 and an amplitude adjustment to one or more of the signals (e.g., the microphone signal 520, the PCD output signal 540, the client output signal 560, and/or the speaker signal 570) may be applied concurrently.

Referring to FIGS. 1-6, interactions between the components 110, 120, 130, 140 are illustrated in accordance with some embodiments. In some embodiments, an active moderator session 610 may be established between the host 120 and the client 130 to enable the communication between the host 120 and the client 130. For example, adjustment requests may be transmitted from the host 120 to the client 130 during the active moderator session 610. In some embodiments, the active moderator session 610 may be established in the beginning of the conference or seminar (or at other suitable time), and remain active throughout (or a portion of) the conference.

In some embodiments, the active moderator session 610 may be established in response to the operator of the host 120 detecting a triggering event (as discussed in the disclosure). For example, in response to the operator perceiving feedback, the operator may use the user interface device 350 of the host 120 to control the host 120 to establish an active moderator session 610 with the client 130. In some embodiments, the active moderator session 610 may be established between the host 120 and the client 130 automatically when an active participant session 620 is established. For example, when the active participant session 620 is established between the PCD 110 and the client 130, the client 130 may automatically send a request to the host 120 to initiate an active moderator session 610. In particular embodiments, if the host 120 confirms the request, then the active moderator session 610 may be established. In other words, an exchange of credentials may prompt a start of the active moderator session 610.

In some embodiments, the active participant session 620 between the PCD 110 and the client 130 may be established to enable communication between the PCD 110 and the client 130. The PCD 110 may transmit the audio signals to the client 130 during the active participant session 620, and the client 130 may provide the adjustment requests to the PCD 110 during the active participant session 620. The adjustment requests may be received from the host 120 or generated by the client 130. In some embodiments, the client 130 may establish the active participant session 620 with a plurality of PCDs 110. In some embodiments, the client 130 may include a plurality of clients, each of the plurality of clients may establish an active session with the host 120.

In some embodiments, the active participant session 620 may be established in response to an indication that the user wishes to access to the PA system 140. In particular embodiments, the user, through the user interface device 250 of the PCD 110, may control the PCD 110 to send an indication to the client 130. In some embodiments, the client 130 may, upon receiving the indication, send a confirmation to the PCD 110 to confirm that the active participant session 620 has been established. In other words, an exchange of credentials may be required to initiate the active participant session 620. In some embodiments, the active participant session 620 may be established in response to an indication from the host 120 and/or the client 130 that the PCD 110 should be granted an active participant session 620. In some embodiments, the operator of the host 120 and/or the client 130 may control the host 120 and/or the client 130 to send the indication via the user interface devices 350, 450. In other embodiments, the host 120 and the client 130 may send the indication automatically. Examples of methods and systems for establishing the active participant session 620 (and/or the active moderator session 610) are described in (but are not limited to) U.S. patent application Ser. No. 13/275,100, herein incorporated by reference in its entirety.

In some embodiments, the client 130 may be operatively coupled, via a connection 630, to the PA system 140 to enable the transfer of the data between the client 130 and the PA system 140. In some embodiments, the connection 630 may be a fixed connection between the client 130 and the PA system 140. In other embodiments, the connection 630 between the client 130 and the PA system 140 may be a wireless network connection.

An advantage associated with configuring the client 130 to establish communication sessions with each of the PCD 110, the host 120, and the PA system 140 can be that each of the host 120, the PCD 110, and the PA system 140 may only need to communicate with one other component to perform their functions in the audio signal adjustment system 100. This allows resources of the host 120, the PCD 110, and the PA system 140 to be conserved.

Referring to FIGS. 1-7, illustrated is a process 700 for adjusting audio signal for the PA system 140 in accordance with various embodiments. At block B710, a session between the PCD 110 and the client 130 may be established. In some embodiments, the session may be an active participant session 620 established in any suitable manner such as (but is not limited to) discussed in the disclosure. The session may be established after an active moderator session 610 between the host 120 and the client 130 is established.

Next at block B720, the client 130 may receive audio signal (e.g., microphone signal 520) sent by the PCD 110. In some embodiments, the audio signal may be sent after the initiation of the active participant session 620, and communication in the active participant session 620 may be provided by the network 150. The PCD 110 may first capture sound 510 with at least one microphone 210, then convert the captured sound into the audio signal (e.g., microphone signal 520) with the at least one processor 220 and the at least one memory unit 230 for transferring to the client 130.

Next at block B730, the client 130 may transmit the received audio signal to the PA system 140 for broadcasting. The client 130 may transmit the audio signal to the PA system 140 over the connection 630. The PA system 140 may receive the transmitted audio signal and broadcast the audio signal as outputted sound via the at least one speaker 141.

The audio signal may initially be in a predetermined state, i.e., the state that the audio signal may be transmitted or broadcasted before any adjustment takes place. In some embodiments, the predetermined state may be the natural state of the audio signal without any modifications or adjustments. In other embodiments, the predetermined state may be the state of the audio signal after preliminary modification. The preliminary modification may include adjusting at least one of the microphone signal 520, the PCD output signal 540, the client output signal 560, and the speaker signal 570, deactivating capturing sound in at least one direction of the microphone 210, filtering out at least one frequency range, and/or of the like.

In some embodiments, the preliminary modification may be set manually by the user through the user interface device 250 of the PCD 110, or the operator through the user interface devices 350, 450 of the host 120 and/or the client 130. In other embodiments, the preliminary modification may be set automatically by one or more of the components 110, 120, 130, 140. The component that sets the preliminary modifications may itself perform the preliminary modification, or it may forward a preliminary modification request to another component for modification. Preliminary modification (set manually or automatically) may be saved to at least one user profile of the PCD 110 so that the user may select to preliminarily modify the audio signals in accordance with the preferences set forth in the user profile. In addition, preliminary modifications relating to a plurality of users may be saved to separate user profiles of a same PCD 110.

In some embodiments, setting the predetermined state may include scaling at least one of the signals 520, 540, 560, 570 by at least one predetermined scaling factor. In one example, at least one predetermined scaling factor greater than 1 (e.g., 1.2, 1.5, or 3) may be applied to increase the amplitude of the signals 520, 540, 560, 570. In another example, at least one predetermined scaling factor less than 1 but greater than 0 (e.g., 0.3, 0.5, or 0.8) may be applied to decrease the amplitude of the signals 520, 540, 560, 570. In some embodiments, a same predetermined scaling factor may be applied to a plurality of the signals 520, 540, 560, 570. In other embodiments, two or more different predetermined scaling factors may be applied to the plurality of the signals 520, 540, 560, 570.

In some embodiments, the predetermined scaling factor may be fixed (e.g., 0.3, 0.5, 0.8, 1.2, 1.5, or 3) such that the same predetermined scaling factor may be applied to at least one of the signals 520, 540, 560, 570 in the beginning of every session. In other embodiments, the predetermined scaling factor may be determined dynamically and automatically by at least one of the components 110, 120, 130, 140, such that a different predetermined scaling factor may be applied in the beginning of every session. In particular embodiments, the dynamic determination may be based at least in part on the speaking habit of the user of the PCD 110 and/or the environment in which the PA system 140 is deployed. With respect to the speaking habit of the user, the predetermined scaling factor may be applied to scale the audio signals 520, 540, 560, 570 if the user may have been the cause of feedback or insufficient output volume that had occurred previously. In some examples, the user may be the cause if the user speaks too loudly/softly or holds the PCD 110 too close/far. Further, the environment (e.g., the placement of the speakers, the acoustics of the conference room in which the PA system 140 may located) may also impact audio signals such that a triggering event may occur. In some embodiments, the PCD 110 may save data related to previous usage of the PCD 110 in the memory unit 230 and select the predetermined scaling factors based on the saved data. In particular, the data may include, among others, previous predetermined scaling factors applied, scaling factors used in the adjustment process, past sessions identifiers that may identify each session to which the PCD 110 may have connected to, a mapping vector containing pointers that map the scaling factors to corresponding sessions. In some embodiments, the predetermined scaling factor may be the same as a last scaling factor or a sum of total scaling (i.e., sum of total scaling refers to multiplying all scaling factors applied in a session; for example, if two scaling factors, 0.8 and 0.5, were applied in a previous session, then the sum of total scaling is 0.8 multiplied by 0.5, which is 0.4) applied in a previous session. In another example, the predetermined scaling factor may be the average of the sum of total scaling of last ten sessions.

In some embodiments, the predetermined state may refer to the microphone 210 of the PCD 110 being initially configured to capture sound in at least one predetermined sound-capturing direction. The predetermined direction may be some or all available sound-capturing directions of the microphone 210. The PCD 110, the host 120, and/or the client 130 may automatically set the predetermined direction based at least in part on the speaking habit of the user of the PCD 110 and/or the environment in which the PCD 110 is used as a microphone. In some embodiments, the PCD 110 may save data related to previous usage of the PCD 110 in its memory unit 230 and select the predetermined direction based at least in part on the saved data. The saved data may include, among others, previous sound-capturing directions, directions eliminated in a previous session, and corresponding session identifiers that may identify each of the session to which the PCD 110 was connected to. In some embodiments, the predetermined sound-capturing direction correspond to the predetermined direction applied in a most recent session. In another example, the predetermined direction may be all available sound-capturing directions other than at least one direction that may be frequently deactivated during the adjustment process in a number of previous sessions.

In some embodiments, the predetermined state may also refer to initially configuring the PCD 110 to transmit the audio signal at a predetermined frequency range. The predetermined frequency range may be the entire available frequency spectrum or a subset of the entire frequency spectrum. The PCD 110, the host 120, and/or the client 130 may automatically set the predetermined frequency range based at least in part on the speaking habit of the user of the PCD 110 and/or the environment in which the PCD 110 is used as a microphone. For example, acoustics of the room and placement of the speakers may cause a certain frequency range to contain feedback. In some embodiments, the PCD 110 may save data related to previous usage of the PCD 110 in its memory unit 230 and select the predetermined frequency range based at least in part on the saved data. The saved data may include, among others, frequency ranges filtered out in previous sessions, previous predetermined frequency ranges, and corresponding session identifiers that may identify each of the session to which the PCD 110 was connected to. For example, in some embodiments, the predetermined frequency range may correspond to a frequency range applied in a most recent session (i.e., the frequency range after filtering out at least one frequency range in the most recent session).

Two or more of the preliminary modification schemes disclosed above regarding the predetermined state (e.g., setting a predetermined scaling factor, predetermined sound-capturing direction, and predetermined frequency range) may be implemented in any combination. Transmitting and broadcasting the audio signal in the predetermined state as set forth above may allow the audio signal to be preliminarily modified before any further adjustment occurs. As the preliminary modification process may be based on the speaking habit and/or the environment, fewer iterations of the adjusting loop may be required to further adjust the audio signals, thus improving the efficiency of the adjustment process.

Next at block B740, a triggering event may be monitored for. A triggering event is an event that, if occurs, may require adjustment of the audio signal. In various embodiments, a triggering event may be an occurrence of feedback, insufficient output volume, and/or the like. In some embodiments, a triggering event can be monitored manually by the operator of the host 120 (i.e., the operator may listen to the sound outputted by the PA system 140 for a triggering event). In some embodiments, the operator of the host 120 may detect both types of triggering events simultaneously from a single PCD 110 (e.g., both feedback and insufficient output volume) or two or more triggering events simultaneously from two or more PCDs 110 that are connected to the PA system 140 at the same time (e.g., feedback for one of the PCDs 110 and insufficient output volume for the other one of the PCDs 110, or insufficient output volume for both of the PCDs 110).

Next at block B750, if a triggering event is not detected (B750:No), then no action may be taken by the host 120, given that the operator of the host 120 does not perceive that a triggering event occurred. Subsequent audio signal may be received at B760 and processed according to blocks B730-B750 (i.e., audio signal may be continuously received, broadcasted, and monitored) until a triggering event is detected. In some embodiments, if a triggering event has not been detected in a predetermined amount of time (e.g., 100 ms, 150 ms, or 300 ms), an indication indicating that a triggering event has not occurred in that given time period may be sent automatically or manually (by the operator), through the user interface device 350 of the host 120, to the PCD 110.

On the other hand, at block B770 (B750:Yes), an adjustment request may be sent by the host 120 in response to a triggering event being detected. In some embodiments, the operator may instruct the host 120, with the user interface device 350 of the host 120, to send the adjustment request. In one example, the host 120 presses a touch screen or a button to indicate to the host 120 that feedback was detected. The host 120, in response, may send the adjustment request to the client 130 and/or the PCD 110. In some embodiments, the host 120 sends the adjustment request to the client 130. The client 130 then provides the adjustment request to the PCD 110. In some embodiments, the user interface device 350 of the host 120 may allow the operator to select the type of triggering event (e.g., feedback or insufficient output volume), the PCD 110 (in the case that multiple PCDs 110 may be connected) that may be responsible for the triggering event, preset options for the operator to input the audio signals 520, 540, 560, 570 to be adjusted, the details of adjustment, and/or the like. In some embodiments, the display of the user interface device 350 of the host 120 may show a confirmation to the operator that the adjustment request has been sent.

Next at block B780, the PCD 110 may receive (capture) subsequent audio signal. Next at block B790, the PCD 110 and/or the client 130 may adjust the subsequent audio signal in response to the adjustment request. In various embodiments, the PCD 110, the client 130, and/or the PA system 140 may be configured to perform different actions depending on the type of the adjustment request being sent from the host 120. The adjusted subsequent audio signal may then be processed according to blocks B730-B750.

Referring to FIGS. 1-8, illustrated (by at least one of the components 110, 120, 130, 140) is an example of a process 800 through which audio signal may be adjusted automatically (by at least one of the components 110, 120, 130, 140) in accordance with various embodiments. At block B810, a threshold value may be provided to at least one of the components 110, 120, 130, 140. In some embodiments, a plurality of threshold values may be provided to the at least one components 110, 120, 130, 140. The threshold value may be a threshold signal energy content value or a threshold audio signal amplitude. In some embodiments, the threshold value may be set by at least one of the components 110, 120, 130, 140 automatically. In other embodiments, the threshold value may be set by the user via the user interface device 250 of the PCD 110, or the operator via the user interface device 350 of the host 120.

Next, at block B820, a session between the PCD 110 and the client 130 may be established. In some embodiments, the session may be an active participant session 620 that can be established in any suitable manner such as (but is not limited to) discussed in the disclosure. The session may occur after an active moderator session 610 between the host 120 and the client 130 is established.

Next, at block B830, the PCD 110 may send the audio signal to the client 130. In some embodiments, the audio signal may be sent after the initiation of the session, and communication in the session may be viable through the network 150. The PCD 110 may first capture sound 510 with at least one microphone 210, then convert the captured sound into audio signal (microphone signal 520), with the at least one processor 220 and the at least one memory unit 230, for transferring to the client 130. In some embodiments, the PCD 110 may initially transmit the audio signal in a predetermined state in any suitable manner such as (but is not limited to) discussed in the disclosure.

Next at block B840, the received audio signal may be transmitted to the PA system 140 for broadcasting. The client 130 may transmit the audio signal to the PA system 140 over the connection 630. The PA system 140 may receive the transmitted audio signal and broadcast the audio signal as outputted sound via its at least one speaker 141.

Next at block B850, at least one of the components 110, 120, 130, 140 (i.e., at least one detecting component) may analyze the outputted audio signal and compute an assessment value for the outputted audio signal. In some embodiments, the PCD 110 may, via its at least one microphone 210, capture the outputted sound and convert the outputted sound into audio signal. Then, the PCD 110 may analyze the audio signal and compute an assessment value with the at least one processor 220 and the at least one memory unit 230. In particular embodiments, the assessment value may represent the energy content of the audio signal. For example, the energy content may be calculated by computing a quadratic mean of the collected audio signal for a predetermined duration (e.g., 10 ms, 50 ms, 100 ms, or 110 ms). Quadratic mean may be calculated as following over n samples ($x_1, x_2, x_3, \ldots, x_n$).

$$X_{(mean)} = \sqrt{\frac{1}{n}(x_1^2 + x_2^2 + x_3^2 + \ldots + x_n^2)}$$

At block B860, the assessment value may be compared to the threshold value. In some embodiments, one of the components 110, 120, 130, 140 (e.g., the PCD 110 or the host 120) may forward the assessment value to another component to which the threshold value may be provided for performing the comparison. In other embodiments, the component that computed the assessment value may itself compare the assessment value with the threshold value.

Next, at block B870 (B860:NO), if the assessment value does not exceed the threshold value (signifying that a triggering event has not occurred), no adjustment may be taken by any of the components 110, 120, 130, 140. Therefore, at block B870, the subsequent audio signal may be received by the client 130 but no adjustment may occur. The subsequent audio signal may be transmitted to the PA system 140 for broadcasting at block B840, thus starting another iteration of the process 800.

On the other hand, if the threshold value is exceeded by the assessment value, then at least one of the components 110, 120, 130, 140 (i.e., at least one adjusting component) may adjust the subsequent audio signal based on a set adjustment criteria. For example, at block B880 (B860:YES), the subsequent audio signal may be received by the adjusting component, and the adjusting component may adjust the subsequent audio signal. In some embodiments, the component that automatically detects the triggering event may not be the component that performs the adjustment. For example, the automatic detection process may occur in the host 120 while the automatic adjusting process may occur in the PCD 110. Similar to what was disclosed above, an adjustment request may be sent from the detecting component to the adjusting component via the network 150, and the adjusting component may adjust the subsequent audio signal based on the adjustment request. For example, the component may adjust the amplitude of the subsequent audio signal by adjusting at least one of the audio signals 520, 540, 560, 570, the sound-capturing directions of the microphone 210, the frequency range, and/or the like. In particular embodiments, the adjustment details may be based on the difference between the assessment value and the threshold value. For example, if the assessment value exceeds the threshold value by a given amount (e.g., if the assessment value is 150%, 300%, or 500% of the threshold value), then at least one scaling factor (e.g., 0.6, 0.8, or 0.9) that corresponds to the amount may be applied.

In some embodiments, the detecting component may compute the assessment value for the audio signals periodically (e.g., every 0.05, 0.1, 0.3, or 0.5 seconds). In some embodiments, every time the detecting component detects a triggering event (i.e., when the assessment value exceeds the threshold value), the detecting components may send an adjustment request locally or via a network 150 to other components. In other embodiments, the detecting component may send an adjustment request when it detects a triggering event, and may send a confirmation indication when the triggering event has subsided.

Figure 9C:
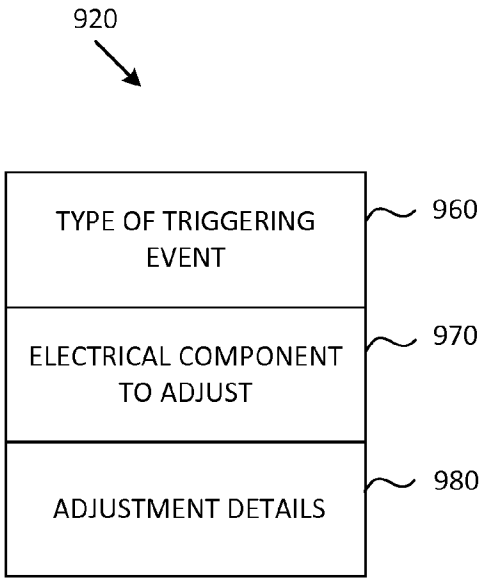
FIGS. 9A-9C are block diagrams illustrating adjustment requests according to various embodiments.
Figure 9B:
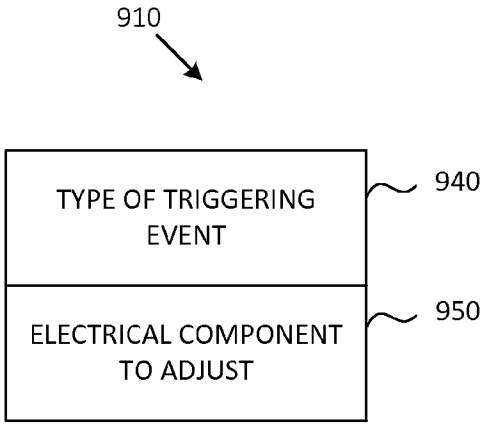
Figure 9A:
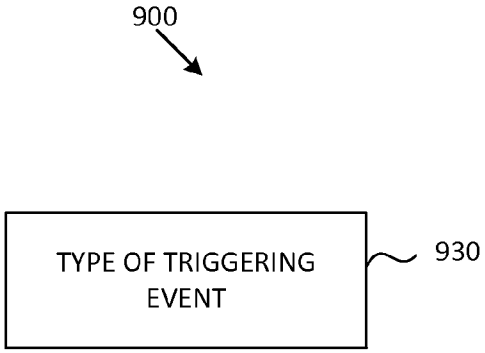
Figure 10A:
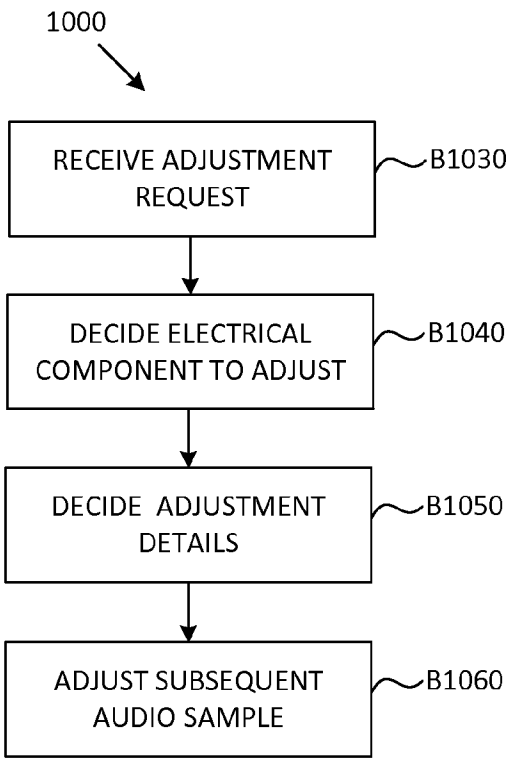
FIGS. 10A-10C illustrate process flowcharts of methods performed in response to adjustment requests according to various embodiments.
Figure 10B:
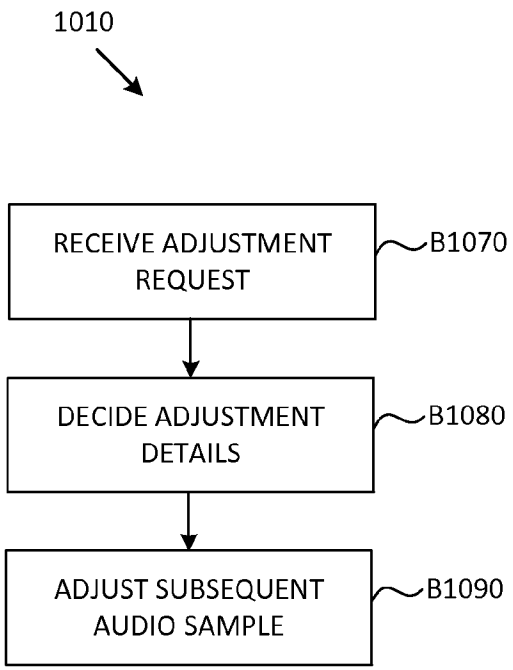
Figure 10C:
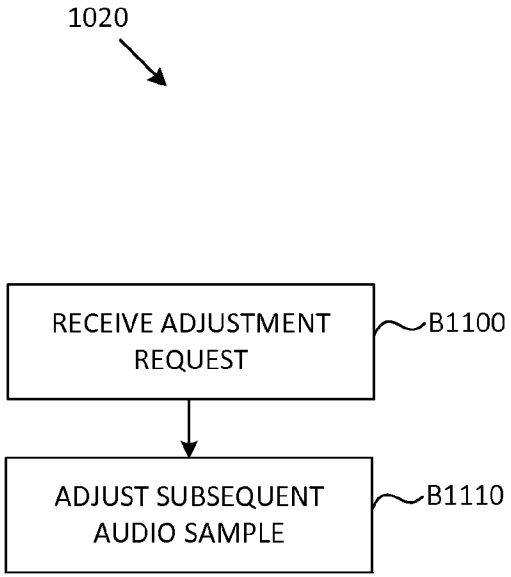
Figure 11:
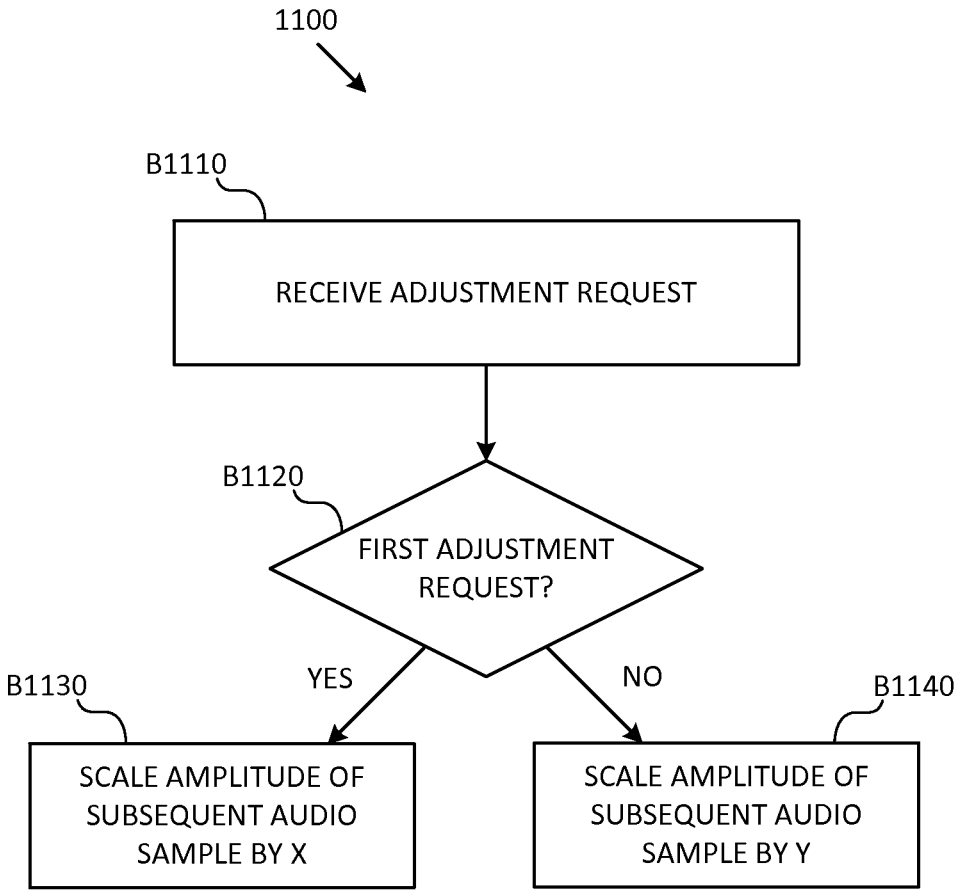
FIG. 11 illustrates a process flowchart of a method for adjusting the audio signals in response to two or more adjustment requests according to various embodiments.
Figure 12:
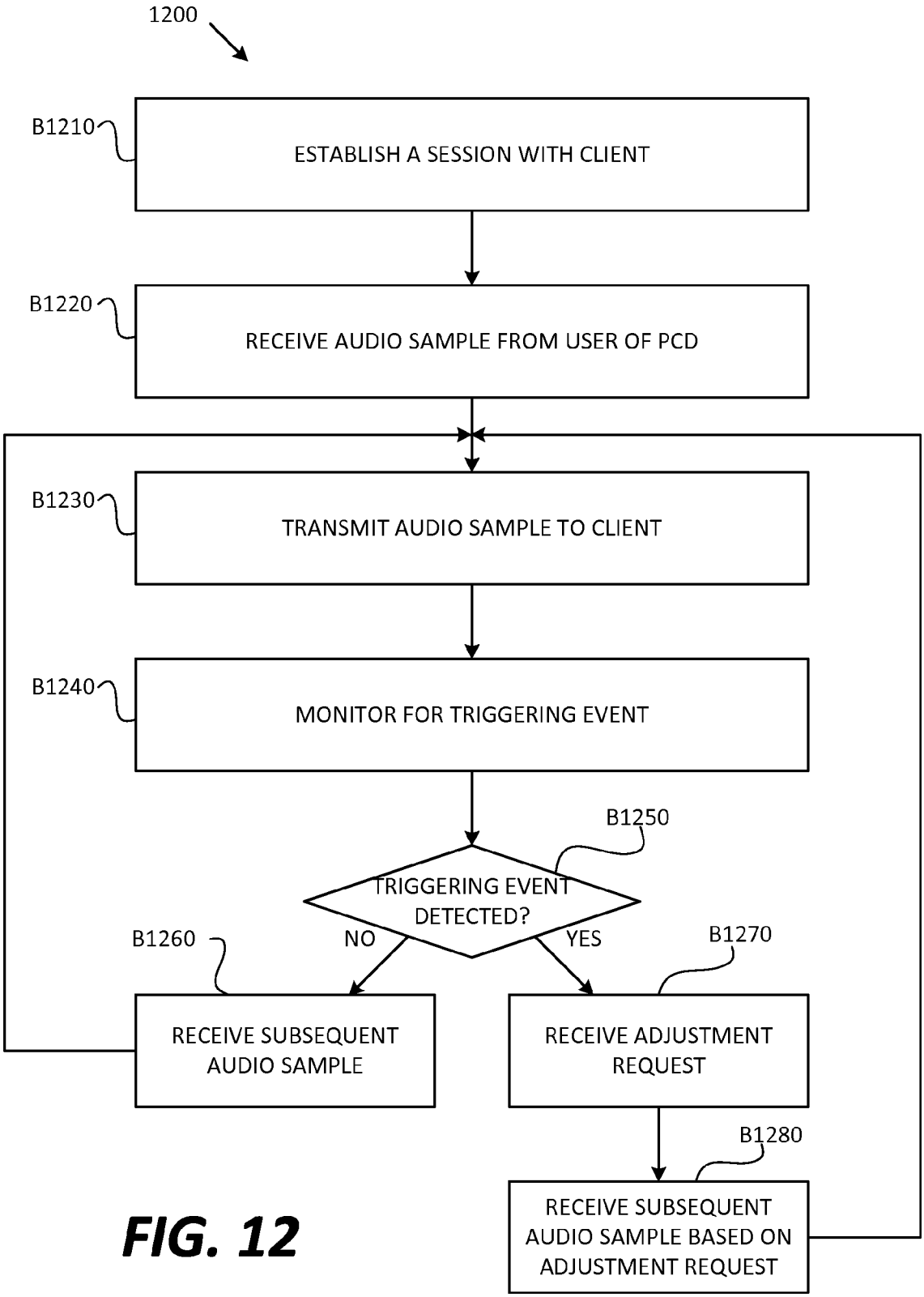
FIG. 12 illustrates a process flowchart of a method for adjusting audio signals by a PCD according to various embodiments.

FIGS. 9A-9C represent embodiments of adjustment requests 900, 910, 920. Referring to FIGS. 1-8 and 9A, an example of the adjustment request 900 is illustrated in accordance with some embodiments. The adjustment request 900 may include a message 930 that may indicate the type of triggering event that may be detected. In embodiments where the system may be configured to monitor and adjust for one type of triggering event (e.g., feedback or insufficient output volume, but not both), the adjustment request 900 may only include a message that indicates a triggering event has occurred.

The PCD 110, upon receiving the adjustment request 900 from the host 120 or the client 130, adjusts the subsequent audio signal according to a set of criteria. Referring to FIGS. 1-8, 9A, and 10A, illustrated is an process 1000 for adjusting the subsequent audio signal once the adjustment request 900 is received. At B1030, the adjustment request 900 having a message 930 that indicates the type of triggering event may be received by the PCD 110. Next at B1040, the PCD 110 adjusts the microphone signal 520 in response to the request. For example, if the triggering event is a feedback, then the PCD 110 may reduce the amplitude of the subsequent audio signal, filter out frequency ranges, deactivate sound-capturing directions of the microphone 210, and/or the like. In some embodiments, if the triggering event is insufficient output volume, then the PCD 110 may increase the amplitude of the subsequent audio signal. In other embodiments, the adjustment request may be sent to the client 130 for adjusting the PCD output signal 540 in response to the request, and/or to the PA system 140 for adjusting the client output signal 560 and/or the speaker signal 570.

Next at B1050, the PCD 110 may select adjustment details (e.g., the amount and manner of adjustment with respect to the microphone audio signal 520 being adjusted). In some embodiments, the PCD 110 may select to scale the amplitude of the subsequent microphone audio signal by a fixed factor (e.g., 0.2, 0.5, 0.7, 1.2, 1.5, or 3). In some embodiments, the PCD 110 may select at least one sound-capturing direction of the microphone 210 to be deactivated. In some embodiments, the PCD 110 may select at least one frequency range to be filtered out. Next at B1060, the PCD 110 may adjust the subsequent microphone audio signal according to the selection made by the PCD 110.

Referring to FIGS. 1-8, and 9B, the adjustment request 910 may include a message 940 that indicates the type of triggering event detected and a command 950 to adjust at least one of the audio signals 520, 540, 560, 570. For example, the command 950 may be a command to adjust the amplitude of the microphone signal 520 and the PCD output signal 540. In some embodiments, the command 950 may be set by the operator manually via the user interface device 350 of the host 120. In other embodiments, the command 950 may be set by the host 120 automatically according to any suitable criteria including, but are not limited to, processing time and power consumption.

Referring to FIGS. 1-8, 9B, and 10B, at B1070, the adjustment request 910 having the message 940 and the command 950 may be received by the PCD 110, the client 130, and/or the PA system 140. Next at B1080, the adjustment details is determined with respect to the at least one of the audio signals 520, 540, 560, 570 specified by the command 950 of the adjustment request 910. Lastly at B1090, the PCD 110, the client 13, and/or the PA system 140 may adjust the subsequent audio signal according to the adjustment details determined.

In some embodiments, the PCD 110, the client 130, and/or the PA system may adjust the at least one of the audio signals 520, 540, 560, 570 by a fixed factor for every adjustment request 900, 910 received. For example, in response to the PCD 110 receiving any adjustment request 900, 910 indicating that feedback is the triggering event, the PCD 110 may reduce the microphone signal 520 by a fixed factor (e.g., 0.05, 0.1, or 0.2).

In some embodiments, the PCD 110, the client 130, and/or the PA system may be configured to respond to the adjustment request 900, 910 with a set of predetermined responses when two or more adjustment requests 900, 910 may be received. In particular embodiments, a different scaling factor may be applied in response to each adjustment request 900, 910 in a sequence of adjustment requests. Referring to FIGS. 1-8 and 9-11, illustrated is an example of a process 1100 in which the PCD 110, the client 130, and/or the PA system 140 may be configured to respond to two or more adjustment requests 900, 910. At B1110, the PCD 110 and/or the client 130 may receive an adjustment request 900, 910 containing either only the type of triggering event 930 or the type of triggering event 940 and the audio signals 520, 540, 560, 570 to be adjusted 950. At B1120, a determination may be made as to whether the adjustment request 900, 910 received may be a first adjustment request received. In some embodiments, the first adjustment request may be the first adjustment request received in the current session. In other embodiments, the first adjustment request may be the first adjustment request received in a predetermined period of time (e.g., 30 seconds, 2 minutes, 10 minutes, or an hour) since a last adjustment request was received. If the adjustment request 900, 910 received is the first adjustment request, then at B1130 (B1120:YES), the at least one of the audio signals 520, 540, 560, 570 may be scaled by a first factor, denoted by X. If the adjustment request 900, 910 received is not the first adjustment request, then at B1140 (B1120:NO), the at least one of the audio signals 520, 540, 560, 570 may be scaled by a second factor, denoted by Y. In some embodiments, X and Y may be different, such that X may be greater than Y, or Y may be greater than X. For example, amplitude of the PCD output signal 540 may be reduced by a first factor (e.g., 0.3) in response to a first adjustment request, and reduced by a lesser factor (e.g., 0.05) for every subsequent adjustment request 1200 (e.g., the second adjustment request, the third adjustment request, the fourth adjustment request, etc.) received. In addition, Y, which denotes the scaling factor of any subsequent adjustment in response to the subsequent adjustment requests, may also be different depending on an order in which the adjustment requests 900, 910 may be received. In some embodiments, the PCD 110 may increase the amplitude of the at least one audio signals 520, 540, 560, 570 to compensate for over-reduction of the amplitude, vice versa.

In some embodiments, the PCD 110, the client 130, and/or the PA system 140 may begin to scale the audio signals 520, 540, 560, 570 by a fixed factor periodically (e.g., every 0.05, 0.1, or 0.3 second) in response to the first adjustment request, until no adjustment request 900, 910 has been received by the PCD 110 for a predetermined period of time (e.g., 0.3, 0.5, or 1 second). In some embodiments, the PCD 110, the client 130, and/or the PA system 140 may begin to scale the audio signals 520, 540, 560, 570 by a fixed amount periodically (e.g., every 0.05, 0.1, or 0.3 second) in response to the first adjustment request, until a message indicating that the feedback or the insufficient output volume has been eliminated is received by the PCD 110 and/or the client 130. The message may be sent by the host 120 automatically when the operator has not indicated that a triggering event has occurred for a predetermined time period (i.e., 0.2, 0.5, 1, or 2 seconds) since the last indication.

Referring to FIGS. 1-8 and 9C, the adjustment request 920 may include a message 960 that indicates the type of triggering event that may be detected, a command 970 to adjust at least one of the audio signals 520, 540, 560, 570, and adjustment details 980 that specify how each of the selected audio signals 520, 540, 560, 570 may be adjusted. In some embodiments, the adjustment details can be set by the operator manually via the user interface device 350 of the host 120 or by the PCD 110, the host 120, and/or the client 130 automatically according to any suitable criteria, including but are not limited to, processing time and efficiency.

Referring to FIGS. 1-8, 9C, and 10C, at block B1100, an adjustment request 920 having the message 960, the command 970, and the adjustment details 980 may be received by at least one of the PCD 110, the client 130, and/or the PA system 140. At B1110, the PCD 110 may adjust the subsequent audio signal according to the adjustment details 980. The adjustment details may include, but are not limited to, scaling the amplitude of at least one of the audio signals 520, 540, 560, 570, eliminating at least one sound-capturing direction of the microphone, and filtering out at least one frequency range.

Now referring to FIGS. 1-11, processes described in this disclosure may require a short period of time (e.g., around 90-150 milliseconds, or approximately 110 milliseconds) to complete one iteration via the audio signal adjustment path (i.e., through B750, B770, B780, and B790).

Referring to FIGS. 1-12, illustrated is a process 1200 performed by the PCD 110 for adjusting audio signal for the PA system 140 in accordance with various embodiments. At block B1210, the PCD 110 may establish a session with a client 130 in any suitable manner such as (but is not limited to) discussed in the disclosure. Next at block B1220, the PCD may receive audio signal from the user as the user speaks into the microphone 210 of the PCD 110. Next at block B1230, the PCD 110 may transmit the audio signal received from the user to the client 130 at a predetermined state in any suitable manner such as (but is not limited to) discussed in the disclosure. In some embodiments, the client 130 may transmit the audio signal to the PA system 140 for broadcasting via at least one speaker 141 of the PA system 140. Next at block B1240, a triggering event may be monitored automatically or manually (by the operator of the host 120). Next at block B1260, if a triggering event is not detected (B1250:No), then no action is taken by the host 120, and subsequent audio signal may be received at B1260 and processed according to blocks B1230-B1250. On the other hand, at block B1270 (B1250:Yes), an adjustment request may be received by the PCD 110 in response to a triggering event being detected. Next at block B1280, the PCD 110 may receive subsequent audio signal based on the adjustment request via the microphone 210. In some embodiments, the subsequent audio signal may be adjusted by the PCD 110, the client 120, and/or the PA system 140. For example, the microphone 210 of the PCD 110 may be configured to scale the amplitude of the microphone signal 520 or deactivate at least one sound-capturing direction of the microphone 210 used to capture the subsequent audio signal. In addition, the subsequent audio signal may be adjusted based on the adjustment request in any suitable manner such as (but is not limited to) discussed in the disclosure. The adjusted subsequent audio signal then may be processed according to blocks B1230-B1250.

It is understood that the specific order or hierarchy of steps in the processes disclosed is an example of exemplary approaches. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof Those of skill would further appreciate that the various illustrative logical blocks, components, circuits, and algorithm steps described in connection with the embodiments disclosed herein may be implemented as electronic hardware, computer software, or combinations of both. To clearly illustrate this interchangeability of hardware and software, various illustrative components, blocks, components, circuits, and steps have been described in this disclosure generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, components, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, at least one microprocessors in conjunction with a DSP core, or any other such configuration.

The steps of a method or algorithm described in connection with the embodiments disclosed herein may be embodied directly in hardware, in a software component executed by a processor, or in a combination of the two. A software component may be provided in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor may read information from, and write information to, the storage medium. In the alternative, the storage medium may be integral to the processor. The processor and the storage medium may be provided in an ASIC. The ASIC may be provided in a user terminal. In the alternative, the processor and the storage medium may be provided as discrete components in a user terminal.

In at least one exemplary embodiments, the functions described may be implemented in hardware, software, firmware, or any combination thereof. If implemented in software, the functions may be stored on or transmitted over as at least one instructions or code on a computer-readable medium. Computer-readable media includes both computer storage media and communication media including any medium that facilitates transfer of a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to carry or store desired program code in the form of instructions or data structures and that may be accessed by a computer. In addition, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A system for managing audio for a public addressing (PA) system, comprising:
- a client, the client configured to
  - establish a session with a personal communication device (PCD);
  - receive a first audio sample from the PCD;
  - transmit the first audio sample to the PA system;
  - receive the adjustment request from a host;
  - receive a second audio sample from the PCD; and
  - adjust the second audio sample to suppress feedback, in response to the adjustment request.

2. The system of claim 1, wherein the host is configured to generate the adjustment request in response to detecting a triggering event.

3. The system of claim 2, wherein the triggering event is an input received at the host.

4. The system of claim 1, wherein:
- the second audio sample has an amplitude and a frequency range; and
- adjusting the second audio sample comprises at least one of the following:
  - scaling the amplitude of the second audio sample;
  - changing at least one directionality of a microphone of the PCD; and
  - filtering out the frequency range of the second audio sample.

5. The system of claim 1, wherein adjusting the second audio sample comprises:
- providing the PCD with the adjustment request; and
- receiving at least one adjusted second audio sample from the PCD.

6. The system of claim 1, wherein:
- the second audio sample has an amplitude and a frequency range; and
- the feedback for the PA system is suppressed by
  - scaling the amplitude of the second audio sample;
  - changing at least one directionality of a microphone of the PCD; and
  - filtering out the frequency range of the second audio sample.

7. The system of claim 1, wherein the client receives the adjustment request from the host via a network.

8. A method of adjusting audio signals to suppress feedback for a public addressing (PA) system, the method comprising:
- establishing, by a client, a session with a source device;
- receiving, by a client, a first audio sample from the source device;
- transmitting, by a client, the first audio sample to the PA system;
- receiving, by a client, an adjustment request from a host;
- receiving, by a client, a second audio sample from the source device; and adjusting, by a client, the second audio sample in response to the adjustment request.

9. The method of claim 8, wherein the source device comprises a personal communication device (PCD).

10. The method of claim 8, wherein:

the second audio sample has an amplitude and a frequency range; and adjusting the second audio sample comprises at least one of the following:

scaling the amplitude of the second audio sample;

changing at least one directionality of a microphone of the PCD; and filtering out the frequency range of the second audio sample.

11. A method of managing audio signals for a public addressing (PA) system implementing a personal communication device (PCD), the method comprising:

establishing, by the PCD, a session with a client;

receiving, by the PCD, a first audio sample from a user of the PCD;

transmitting, by the PCD, the first audio sample to the client;

receiving, by the PCD, an adjustment request;

receiving, by the PCD based on the adjustment request to suppress feedback, a second audio sample from the user; and transmitting, by the PCD, the second audio sample to the client.

12. The method of claim 11, wherein the receiving, based on the adjustment request, comprises:

configuring at least one microphone of the PCD based on the adjustment request; and receiving the second audio sample via the configured microphone.

13. The method of claim 12, wherein the receiving, based on the adjustment request, further comprises:

receiving the second audio sample; and adjusting the second audio sample based on the adjustment request.

14. The method of claim 11, wherein the receiving, based on the adjustment request, comprises receiving the second audio sample and adjusting the second audio sample.

15. The method of claim 11, wherein the receiving, based on the adjustment request, a second audio sample from the user, comprises scaling amplitude of the second audio sample changing at least one directionality of a microphone; and filtering out at least one frequency range of the second audio sample.

16. The method of claim 11, wherein the adjustment request is received from the client or a host associated with the client.

17. The method of claim 11, wherein the adjustment request is received in response to a feedback signal.

18. The method of claim 17, wherein the feedback signal is detected by the PCD automatically.

19. The method of claim 18, wherein the PCD is configured to determine whether the first audio sample exceeds a predetermined threshold, and the feedback signal is detected when the first audio sample exceeds the predetermined threshold.

20. The method of claim 17, wherein the feedback signal is detected by the client automatically.

21. The method of claim 20, wherein the client is configured to determine whether the first audio sample exceeds a predetermined threshold, and the feedback signal is detected when the first audio sample exceeds the predetermined threshold.

* * * * *